US009211511B2

(12) United States Patent
Demsia

(10) Patent No.: US 9,211,511 B2
(45) Date of Patent: Dec. 15, 2015

(54) MAGNETIC ATTACHMENT SYSTEM FOR SECURING VESSELS TO A SHAKER

(71) Applicant: Anthony Walter Demsia, South Plainfield, NJ (US)

(72) Inventor: Anthony Walter Demsia, South Plainfield, NJ (US)

( * ) Notice: Subject to any disclaimer, the term of this patent is extended or adjusted under 35 U.S.C. 154(b) by 0 days.

(21) Appl. No.: 14/521,610

(22) Filed: Oct. 23, 2014

(65) Prior Publication Data

US 2015/0043301 A1 Feb. 12, 2015

Related U.S. Application Data

(63) Continuation-in-part of application No. 13/159,713, filed on Jun. 14, 2011, now abandoned.

(60) Provisional application No. 61/356,221, filed on Jun. 18, 2010.

(51) Int. Cl.

| | |
|---|---|
| ***B01L 9/00*** | (2006.01) |
| ***B01F 11/00*** | (2006.01) |
| ***B01F 15/00*** | (2006.01) |
| ***H01F 7/02*** | (2006.01) |
| *B01L 3/08* | (2006.01) |

(52) U.S. Cl.

CPC ..... *B01F 11/0008* (2013.01); *B01F 15/00662* (2013.01); *B01L 9/00* (2013.01); *H01F 7/0252* (2013.01); *B01L 3/08* (2013.01); *B01L 2400/043* (2013.01); *Y10T 29/4995* (2015.01)

(58) Field of Classification Search

CPC ..... B01F 11/0008; B01F 15/00662; B01F 15/00681; B01L 9/00; B01L 3/08; B01L 9/50; B01L 9/52

USPC ..... 248/206.5, 683, 309.1, 309.4; 422/560, 422/561, 562, 566, 556; 366/210

See application file for complete search history.

(56) References Cited

U.S. PATENT DOCUMENTS

| | | | | |
|---|---|---|---|---|
| 4,971,276 | A * | 11/1990 | Tannenbaum | B01F 11/0008 248/154 |
| 6,729,591 | B2 * | 5/2004 | Hsu | G09F 7/04 248/205.6 |
| 8,721,993 | B2 * | 5/2014 | Lockwood | B01L 9/50 366/214 |
| 8,876,367 | B1 * | 11/2014 | Howe | B01F 11/0008 248/316.2 |

* cited by examiner

*Primary Examiner* — Todd M Epps

(74) *Attorney, Agent, or Firm* — Larry E. Severin

(57) ABSTRACT

A magnetic attachment system for securing vessels to a shaker includes a base having an upper side and a lower side; a plurality of flanges on the upper side of the base, each flange having an arm that extends away from the base and engages with the vessel so that the arms retain the vessel to the base; and a magnet on the lower side of the base that magnetically attaches the base to the platform, thereby releasably retaining the vessel to the platform. Each flange may be repositioned at a common distance from the center of the base to accommodate different sizes of vessel.

15 Claims, 7 Drawing Sheets

MAGNETIC ATTACHMENT SYSTEM FOR SECURING VESSELS TO A SHAKER

RELATED APPLICATIONS

This application claims the benefit of the filing date of U.S. Patent Application No. 61/356,221, filed Jun. 18, 2010, which is incorporated herein by reference in its entirety; and U.S. patent application Ser. No. 13/159,713, filed Jun. 14, 2011, which is incorporated herein by reference in its entirety.

BACKGROUND OF THE INVENTION

The present invention generally relates to magnetic platforms and more specifically to magnetic attachment system for securing vessels to a shaker.

A laboratory flask may be glassware or plastic having a wider vessel body and a narrower neck and opening at the top. Flasks for shaking may have a flat bottom and may be conical such as, for example, an Erlenmeyer flask.

Existing laboratory vessel shakers may take time and work to attach flask holders to laboratory shaking or mixing platforms, and may require additional screws or tools. Current technology requires the vessel holder to be attached with the use of screws, nuts and/or other tools. The current system requires tools and hardware such as screws, nuts, bolts, etc. Tools and hardware are not readily available in the laborites that use shakers. In addition, the process of using these tools is time consuming.

Existing shaker vessels are generally suited for a single size of vessel or flask. Users would need to have three different holders, one for each size of commonly used laboratory vessels.

It would be desirable to use magnetism to securely attach a vessel holder to a metallic shaker platform.

SUMMARY OF THE INVENTION

In one aspect of the present invention, a device for a vessel and a metal shaker platform includes a base having an upper side and a lower side; a plurality of flanges on the upper side of the base, each flange having an arm that extends away from the base and engages with the vessel so that the arms retain the vessel to the base; and a magnet on the lower side of the base that magnetically attaches the base to the platform, thereby releasably retaining the vessel to the platform.

In another aspect of the present invention, a device for a flask and a metal shaker platform includes a base having an upper side and a lower side; a plurality of flanges on the upper side of the base, each flange having an arm that extends away from the base and engages with the flask so that the arms securely retain the flask down to the base, each flange being repositionable at a common distance from a center of the base in slots on the upper side of the base so that the device accommodates the size of the flask; and a magnet on the lower side of the base that magnetically attaches the base to the platform, thereby releasably retaining differing sizes of flasks to a metal shaker platform.

In yet another aspect of the present invention, a method for a vessel and a metal shaker platform includes providing a holder assembly having a base with an upper side and a lower side; positioning a plurality of flanges on the upper side of the base, each flange having an arm that extends away from the base and engages with the vessel so that the arms retain the vessel to the base; and attaching a magnet to the lower side of the base that magnetically attaches the base to the platform, thereby releasably retaining the vessel to the platform.

DETAILED DESCRIPTION

Figure 1:
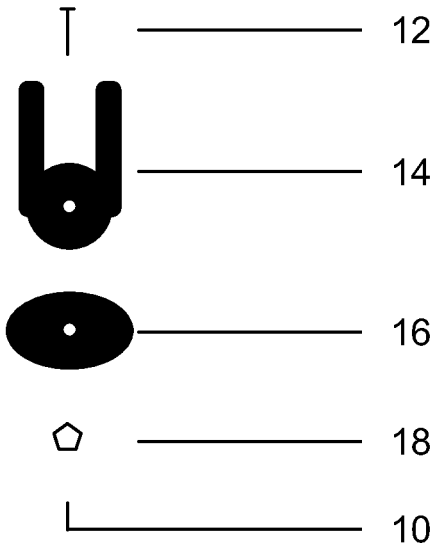
FIG. 1 depicts an exploded view of an embodiment of a flask holder assembly according to the present invention.

The preferred embodiment and other embodiments, which can be used in industry and include the best mode now known of carrying out the invention, are hereby described in detail with reference to the drawings. Further embodiments, features and advantages will become apparent from the ensuing description, or may be learned without undue experimentation. The figures are not necessarily drawn to scale, except where otherwise indicated. The following description of embodiments, even if phrased in terms of "the invention" or what the embodiment "is," is not to be taken in a limiting sense, but describes the manner and process of making and using the invention. The coverage of this patent will be described in the claims. The order in which steps are listed in the claims does not necessarily indicate that the steps must be performed in that order.

Broadly, an embodiment of the present invention generally provides a magnetic attachment system for securing flasks and other laboratory glassware, plastic ware and vessels to the form of a laboratory shaker or mixer.

An embodiment may secure flasks and other laboratory vessels to a shaking platform without the necessity to use additional screws or tools, with the use of magnetism to securely attach the vessel holder to a metallic shaker platform. Embodiments may reduce the time and work associated with the current systems for attaching flask holders to laboratory shaking or mixing platforms.

An embodiment of the present invention may utilize magnetic attraction to replace hardware and tools, and may be used in different formats regarding the placement of the magnet itself. The magnet may be an integral part of the vessel holder or clamp, or may be attached above or below the shaking platform.

Embodiments of the present invention may utilize magnets to attach a flask or vessel to a shaker platform. The vessel may be a flask, tube, laboratory vessel, or other container that is to be shaken. Embodiments may include a high powered magnet that may be secured to the vessel or to a vessel holder. A magnet may be screwed to the base of the vessel holder. The vessel holder may be securely fastened to a metallic, laboratory shaking or mixing platform by making contact between the magnet and the platform.

A person (for example, in a laboratory) may use embodiments of the invention to attach a flask or other vessels to a laboratory shaker or mixer platform. A user may attach a holder having a magnet underneath its base to the vessel, to provide a holder assembly, hold the vessel with the holder assembly, and place the holder assembly upon the platform so as to releasably retain the magnet to the platform.

Embodiments may include a method of retaining a vessel to a shaker platform, comprising: providing a holder that includes magnetic material; holding the vessel with the holder; and utilizing magnetism to attach the magnetic material in the holder to the shaker platform, thereby retaining the vessel to the shaker platform.

In a further embodiment, a flask holder assembly or clamp may have a plurality of flanges or spring clips which are adjustable. Embodiments may have a plurality of flanges, such as 3 or 4, arranged around the rim of a round base, which retain the vessel at multiple sides of the vessel. Each flange may have a bottom, floor, or lower portion that site on the base, which slides horizontally into and out from the center of the base. Each flange also may have an arm or upper portion, that extends away from the bottom but is angled in to help hold a flask. The bottom and arm form a spring clip that presses upon a vessel or flask to retain the vessel to the assembly for shaking in a vessel shaker.

In an embodiment, each of the flanges is repositionable in that it may be repositioned at multiple positions on a line relative to the center of the base, to form a circle or other shape of different diameters. This allows for one clamp to accept 3 or more differently sized flasks, such as, for example, but not limited to, 125 ml, 250 ml, and 500 ml. Slots in the base may be oriented toward the center, such as directly oriented toward the center of the base, or may slant inward toward the center at an angle. If the slots are oriented toward the center at a slanted angle, the flanges would get closer and further from the center, but would also move from side to side to help define predetermined positions for the flanges handled as a unit.

Embodiments of a flange may include a retaining latch that grasps the base when the flange is set to its smallest configuration, or in a single-position embodiment where the base does not support adjustable positions. A user may lift up on the retaining latch to disengage the flange from the base.

Embodiments may include posts or pairs of posts for each flange, such as 4 pairs of posts spaced around the base of the invention. The bottom of each flange may have 3 rectangular apertures that each align with the posts in the base to hold the flange at any one of 3 user-selectable positions. The posts and apertures cooperate to position the flanges at a selected distance from the center of the base and prevent the flange from sliding when the device spins.

To install an embodiment, the flanges may be pressed into slots in the base. The posts and the walls of the slots hold the flanges in place, so the arms can hold the vessel. A flange may be removed by lifting on a retaining latch or tab at the back of the flange, so the flange can be repositioned into another set of posts in the same or another slot. Embodiments may accept three flask sizes used in a scientific laboratory, such as 125 ml, 250 ml and 500 ml.

An embodiment may be made from a plastic base that includes the slots on an upper surface for the plastic flanges, and a magnet compartment or other magnet attachment mechanism underneath the base to hold a round or doughnut-shaped permanent magnet. The magnet may be in the shape of a disk with the center missing. The magnet may be clipped, glued, attached with screws, or otherwise attached into the magnet compartment underneath the base during manufacture. The flanges can be pressed into the slots in the upper surface of the base when the device is ready for use.

In an alternate embodiment, an adjustable flask holder assembly may have a plurality of flanges held together with a flange retainer, which all sit on top of a base. Each flange may have a tab on the bottom that slides along a slot in the base. Each tab may have sideways-extending retainer extensions, distal from the base. This may be a cap at the end of each tab, screw, or bolt, to help retain the tab within a slot in the base. Each slot may have a plurality of tab retaining areas, such as 3 tab retaining areas, which may be notches in the side of the slot. The tab and notch may help keep the flange in one of multiple positions when the tab of a flange slips into one of the notches.

An embodiment of a flange retainer may include a flexible rim or ring that holds each flange so the flange can slide along a corresponding slot in the base, thereby moving the flange in and out toward the center of the base. The rim may hold each flange and help orient the flange to properly face the center of the assembly. The rim may be a plastic or other ring that can be flexed or compressed but will then return to its original shape. The flange retainer may urge the flanges away from the center of the base. The user may compress the ring to manipulate the positions of the flanges, such as by sliding the tab underneath each flange into a different notch. The ring will then tend to expand back to its original shape, and this outward force will hold the tabs within their corresponding notches, thereby helping retain each flange in one of several predetermined positions. Embodiments may have 3 positions, to support 125 ml, 250 ml, and 500 ml flasks.

Embodiments of slots may be aligned off-center, possibly in a spiral, rather than pointing straight toward the center. This arrangement of slots angled inward may allow the flange retainer and flanges to be rotated together as an assembly, relative to the base. Sideways or rotational motion may be redirected into partially radial motion so the flanges will also slide in or out relative to the center. The user may rotate the flanges clockwise into one position to accommodate small flasks, and rotate counterclockwise into a second or third position for medium or large-sized flasks. The user may squeeze the flange retainer slightly to release the tabs from the notches, rotate the flange-and-retainer assembly as desired, and then release the retainer when the tabs click into a different position.

As depicted in the embodiment of FIG. 1, an embodiment of a flask holder assembly 10 may include a screw 12, a flask holder 14, a magnet 16, and a securing nut 18. In an embodiment, the screw 12 passes through an aperture in the flask holder 14, and the securing nut 18 retains the magnet 16 against the bottom of the flask holder 14. The magnet may include iron, nickel, or another magnetic material capable of providing a permanent magnet.

Figure 2:
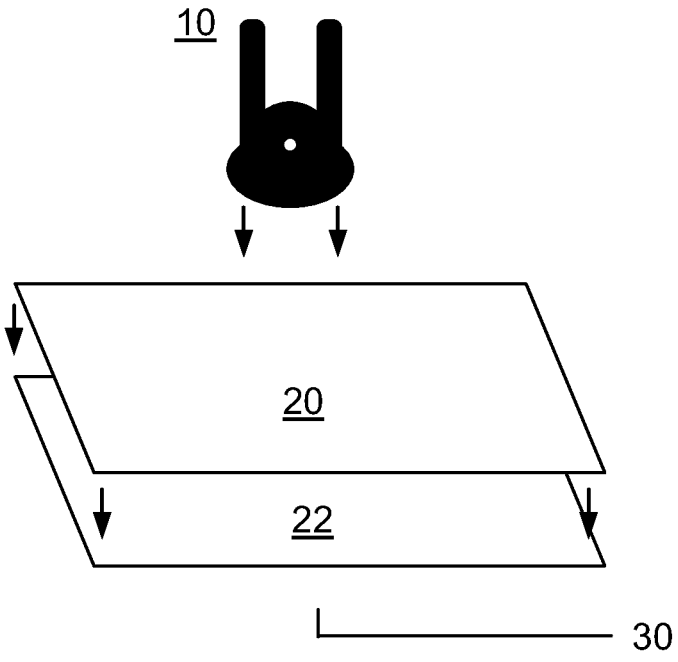
FIG. 2 depicts an embodiment of a magnetic attachment system according to the present invention.

As depicted in the embodiment of FIG. 2, embodiments of a magnetic attachment system 30 may be secured to a rubber mat 20 or other insulating mat that is placed on a steel plate 22 or other iron or magnetic-metal shaker platform. This rubber mat 20 may reduce the magnetic attraction, making it easier to remove the vessel holder's assembly 10. In addition, the rubber mat 20 may protect the metallic platform 22 from scratching, denting or other damage. The insulating mat may be substantially made of rubber or other materials that provide magnetic insulation. The magnetic-metal platform may include steel or other materials that can be attracted to a permanent magnet. The magnetic-metal platform itself does not necessarily have a permanent magnetic field, but should be attracted to the magnetic material in the flask holder assembly 10.

Figure 3:
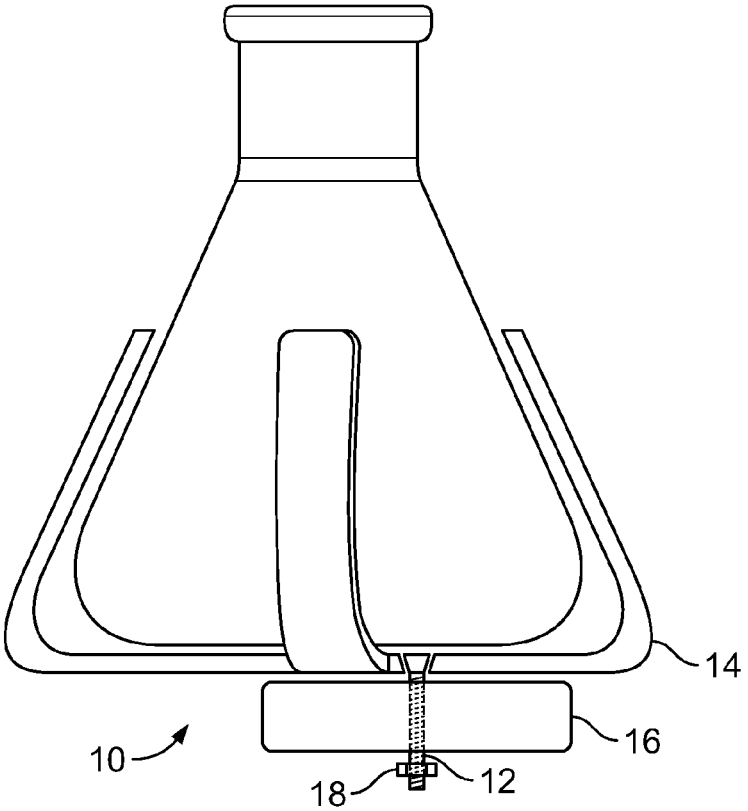
FIG. 3 depicts the embodiment of FIG. 1 retaining a vessel.

As depicted in the embodiment of FIG. 3, the attachment mechanism attaches a magnet to a holder for a vessel. A single standard holder can securely retain the vessel so that the vessel and magnetic attachment system form a unit that may be lifted and placed on the platform, retaining the vessel when shaken by a laboratory shaker, and then lifting and carrying the vessel-plus-magnet holder assembly as a unit.

Figure 4:
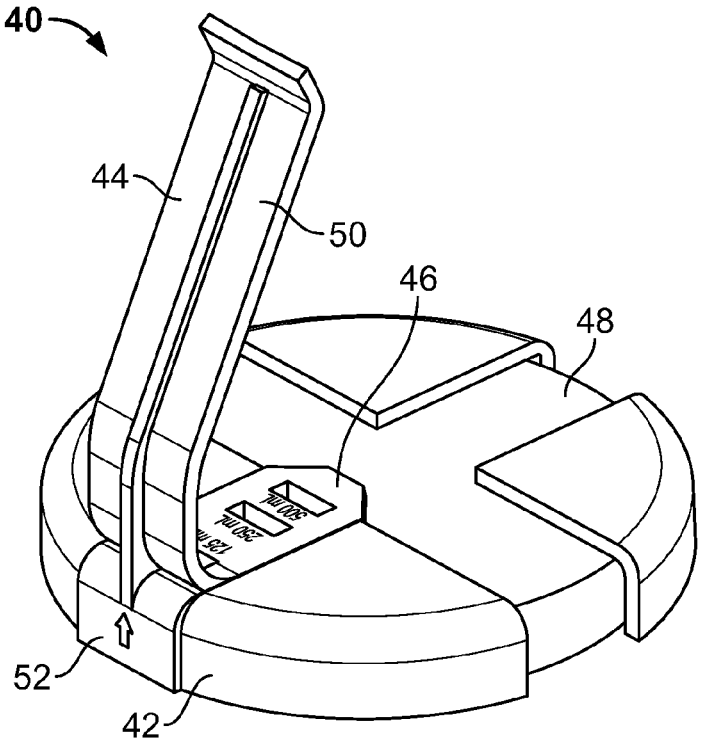
FIG. 4 depicts an embodiment of an adjustable flask holder assembly according to the present invention.

As depicted in FIG. 4, an embodiment of an adjustable flask holder assembly 40 may include a base 42 with a repositionable flange 44. The flange 44 may have a bottom 46 or lower portion that is retained by a slot 48 in the base 42. The flange 44 also may have an arm 50 that is angled in toward the center of the base 42. The bottom 46 and arm 50 form a spring clip adapted to press upon and retain a vessel or flask to the base for shaking in a vessel shaker. In an embodiment, the flange 44 may have a retaining latch 52 that releasably grasps the base 42 to hold the flange 44 to the base 42.

Figure 5:
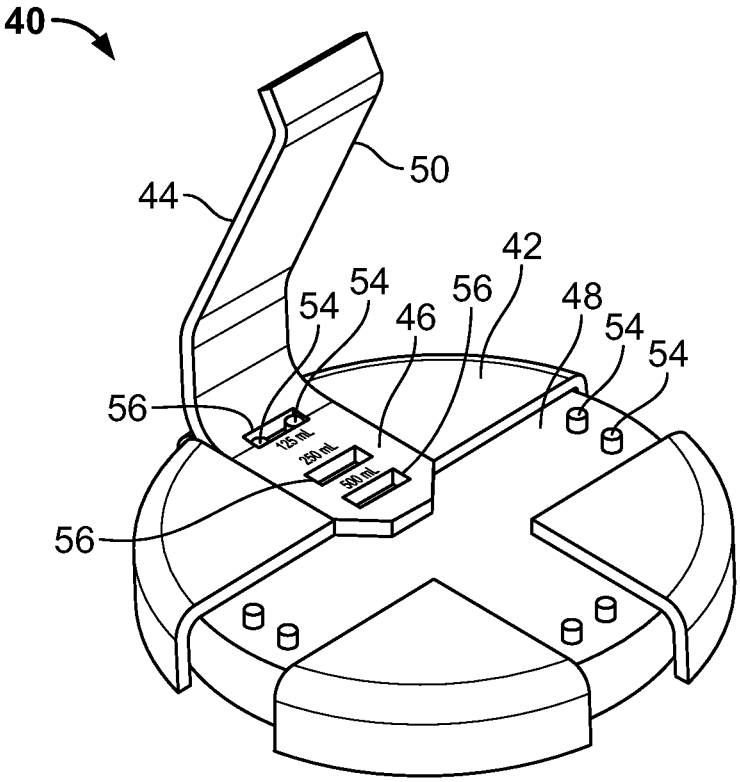
FIG. 5 depicts another embodiment of an adjustable flask holder assembly according to the present invention.

As depicted in FIG. 5, an embodiment of an assembly 40 may include pairs of posts 54 in the slots 48 of the base 42. The bottom 46 of flange 44 may have 3 alignment apertures 56 that align with the posts 54 to hold the flange 44 at any one of 3 user-selectable positions. The slots 48 may be oriented radially toward the center of the base 42 so that the flanges 44 may slide directly in an out from the center into in different locations. Embodiments of slots may be lines directed radially toward the center of the base, or the slots may be tracks that tend toward the center of the base, such as a spiral.

Figure 6:
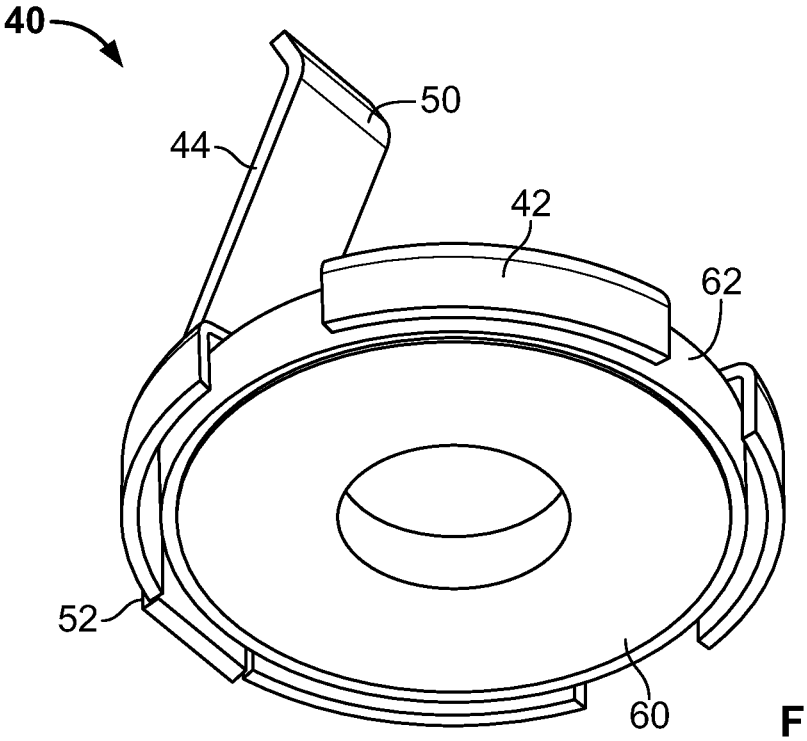
FIG. 6 depicts the embodiment of FIG. 5 from below.

As depicted in FIG. 6, an embodiment of an assembly 40 may include a magnet 60. A round magnet compartment 62 in the base 42 may hold the magnet 60 so that the magnet 60 is directed down and away from the base 42. Magnet 60 may be in the shape of a disk with the center missing. Magnet 60 may be removably clipped into the magnet compartment 62 or held with glue or screws.

Figure 7A:
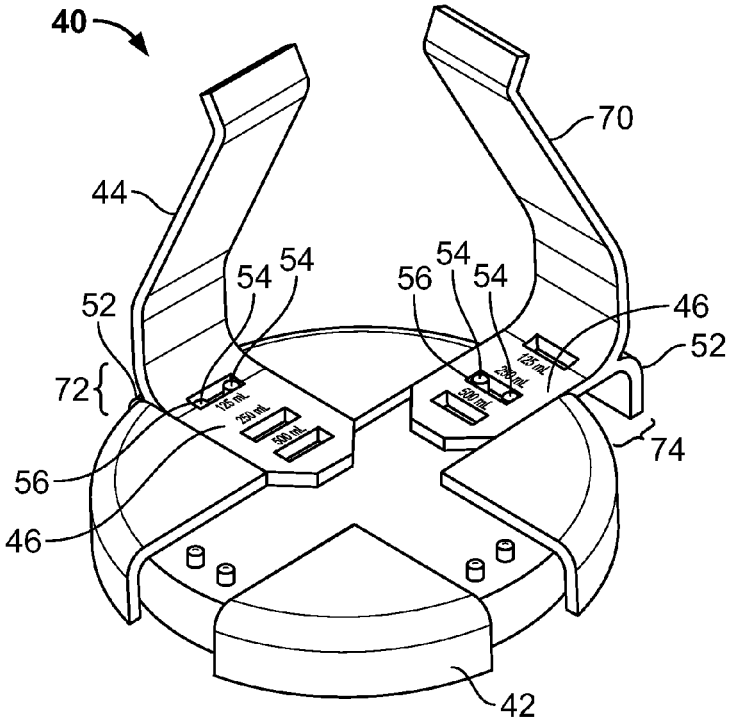
FIG. 7A depicts the embodiment of FIG. 5 with a second flange in a second position.

As depicted in FIG. 7A, an embodiment of an assembly 40 may include a plurality of adjustable flanges including adjustable flange 44 and second adjustable flange 70. In use, the embodiment might have 4 adjustable flanges, all set to the same position to support a round vessel. Flange 44 is depicted in a first position 72, and the posts 54 in the base 42 fit into the rear alignment aperture 56 in the bottom 46 of the flange 44. The retaining latch 52 for flange 44 is pressed against the base 42 because the first position 72 is the smaller configuration (e.g. for 125 mL). The second adjustable flange 70 is in a second position 74, and the posts 54 in the base 42 fit into the middle alignment aperture 56 in its bottom 46. The retaining latch 52 for flange 70 sticks out from the base 42 because second position 74 is for the middle configuration (e.g. for 250 mL).

Figure 7B:
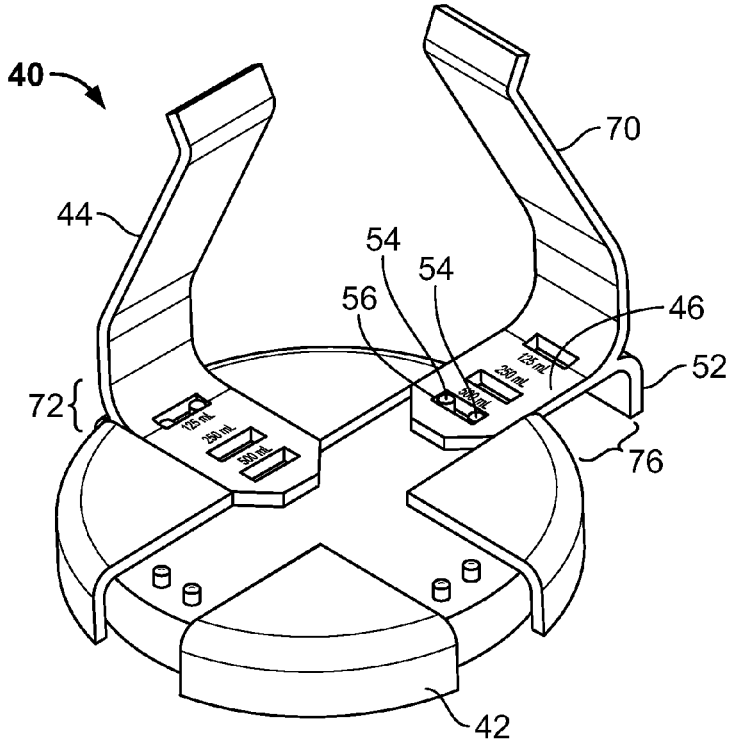
FIG. 7B depicts the embodiment of FIG. 5 with a second flange in a third position.

As depicted in FIG. 7B, the second adjustable flange 70 may be in a third position 76, so the posts 54 fit into the front alignment aperture 56 for a large configuration (e.g. for 500 mL). In use, an embodiment may have 4 adjustable flanges all positioned at the same size position.

Figure 8:
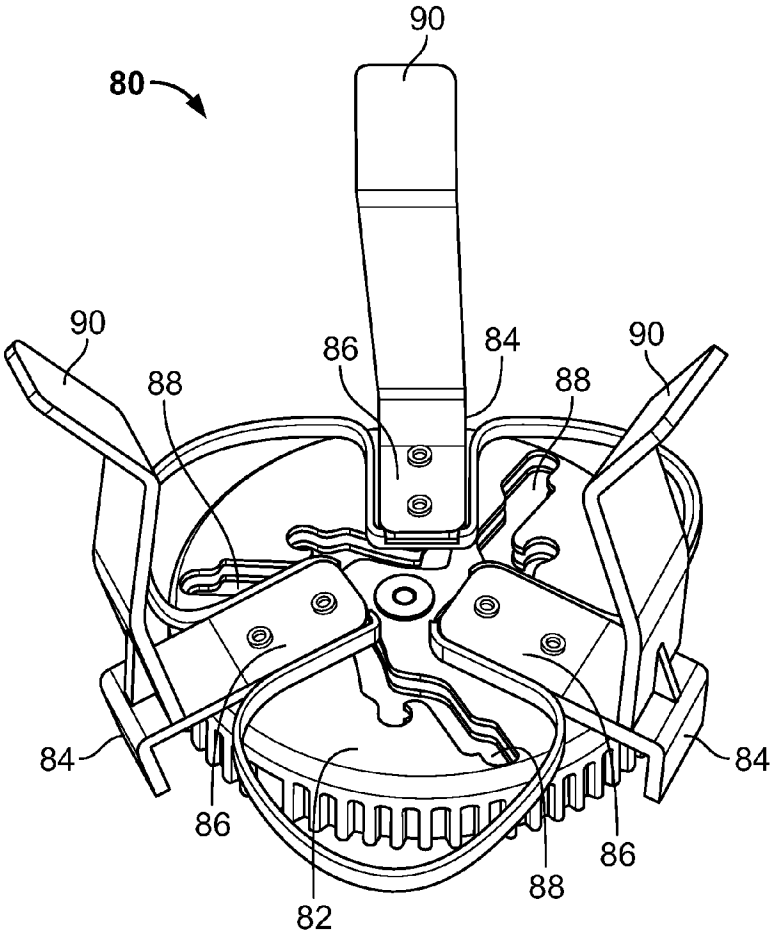
FIG. 8 depicts an alternate embodiment of an adjustable flask holder assembly according to the present invention.

As depicted in FIG. 8, an embodiment of an adjustable flask holder assembly 80 may include a base 82 with 3 repositionable flanges 84. Each flange 84 may have a bottom 86 or lower portion that is retained by a slot 88 in the base 82 and an arm 90 that helps retain a vessel to the assembly 80 for shaking in a vessel shaker. The bottom 86 of each flange 84 may have a tab 92 that slides along a slot 88 in the base 82. Embodiments may have other quantities of flanges, such as 4.

An upper assembly 100 may include a flange retainer 102 which includes a flexible rim 104. The rim 104 connects the flanges 84 in a ring so that the entire assembly 100 may be handled as a unit. The upper assembly 100 sits on top of the base 82, to help hold each flange 84 in place and in the proper orientation. The upper assembly 100 may be rotated relative to the base 82 so that the tab 92 in each flange 84 slides both sideways and in or out within its slot 88.

The slots 88 in the base 82 may be oriented toward the center of the base 82 so that the flanges 84 may be positioned to hold differently sized vessels. The slots 88 may include 3 or more tab retaining areas 94, which may be notches in the side of the slot 88.

Figure 9A:
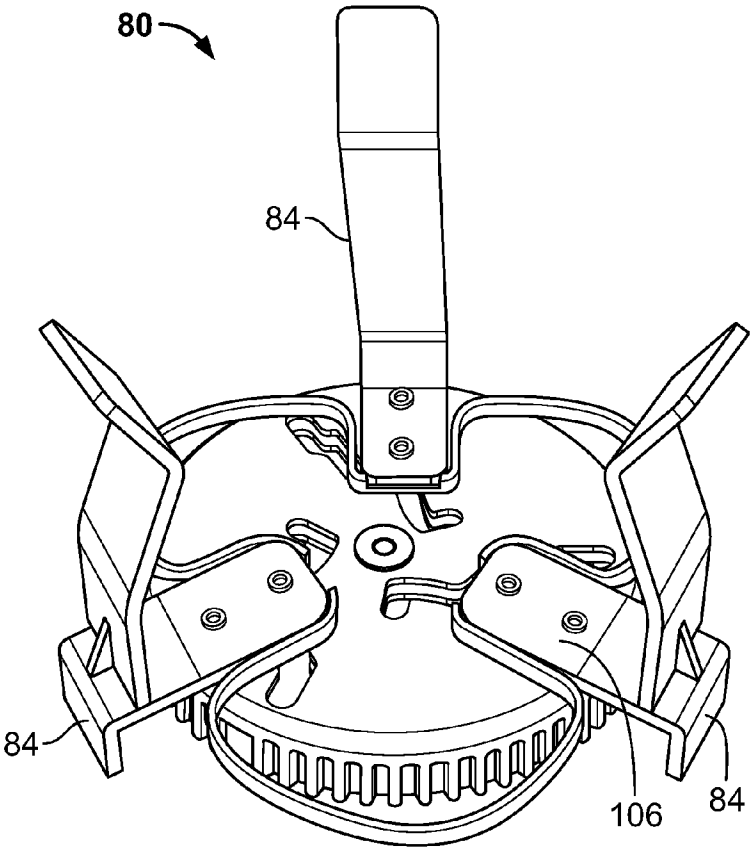
FIG. 9A depicts the embodiment of FIG. 8 in a second position.
Figure 9B:
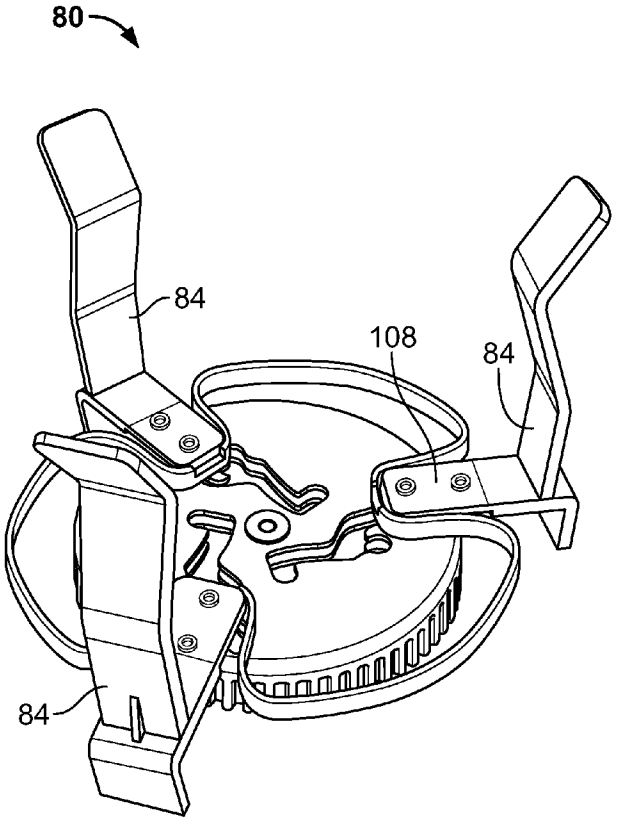
FIG. 9B depicts the embodiment of FIG. 8 in a third position.

FIG. 8 depicts an embodiment of an adjustable flask holder assembly 80 in a first position, where the flanges 84 are positioned in the innermost tab retaining areas 94, to support a small flask. FIG. 9A depicts the embodiment in a second position 106, where the flanges 84 are positioned in the middle tab retainer areas 94, to support a medium-sized flask. FIG. 9B depicts the embodiment in a third position 108, where the flanges 84 are positioned in the outermost tab retainer areas 94, to support a large-sized flask.

Figure 10:
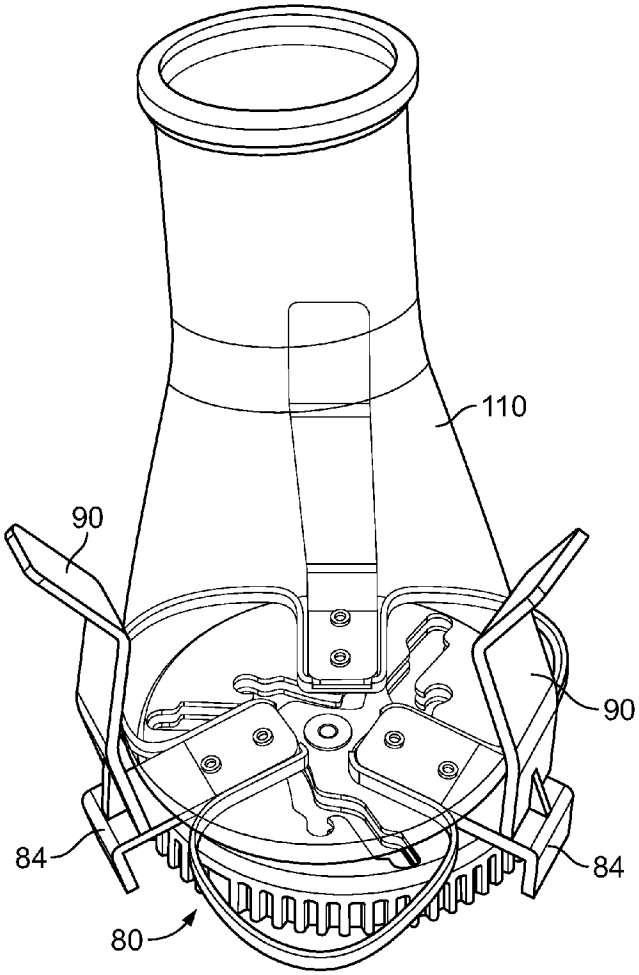
FIG. 10 depicts the embodiment of FIG. 8 in use with a flask.

FIG. 10 depicts an embodiment of an adjustable flask holder assembly 80 retaining a laboratory flask 110. The arms 90 of the flanges 84 press against the flask 110 and retain it to the assembly 80.

Figure 11:
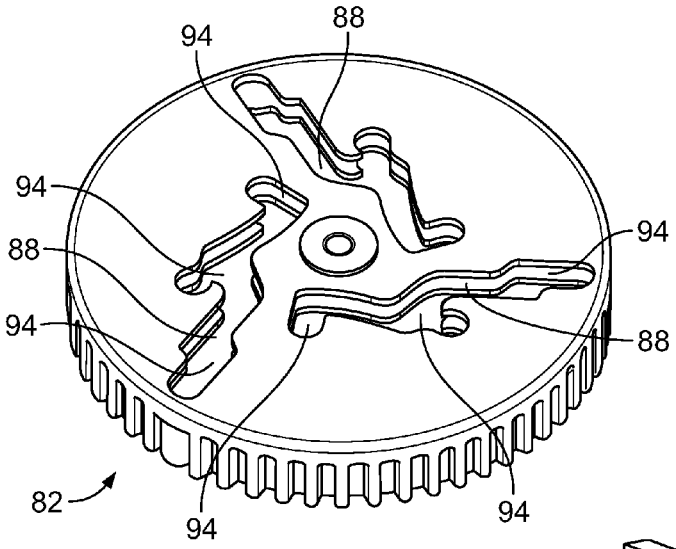
FIG. 11 depicts the base of the embodiment of FIG. 8.

FIG. 11 depicts an embodiment of a base 82 having 3 slots 88, each slot 88 having 3 tab retaining areas 94. A magnet may be attached on the lower side of the base.

Figure 12:
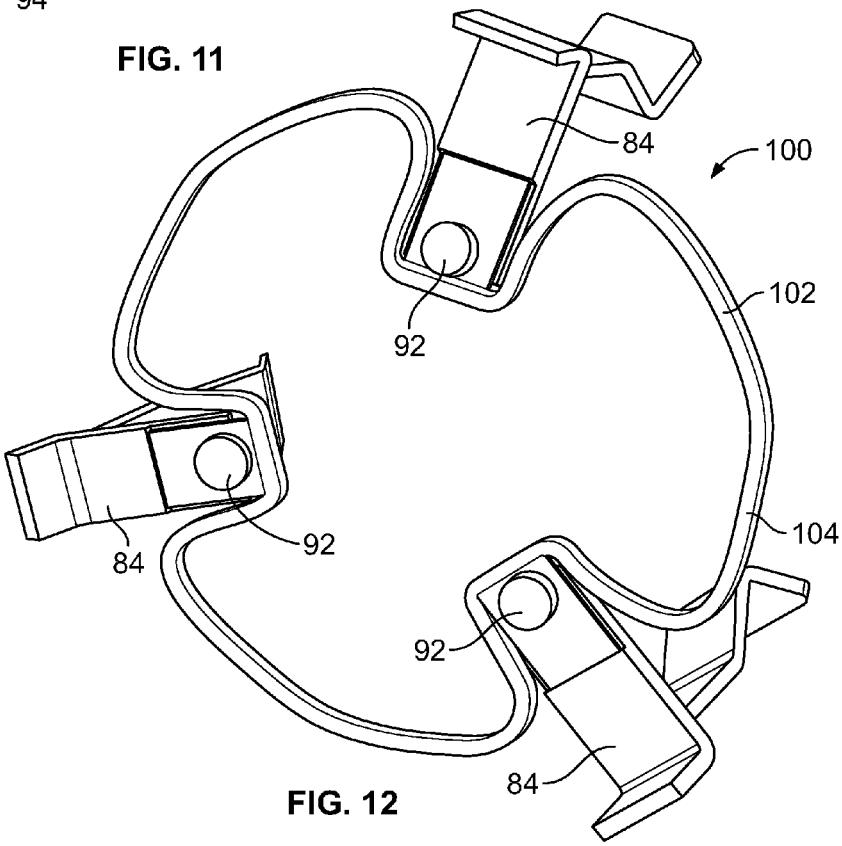
FIG. 12 depicts the upper assembly of the embodiment of FIG. 8.

FIG. 12 depicts an embodiment of an upper assembly 100 having a flange retainer 102 with 3 flanges 84 connected together with a flexible rim 104. Each flange 84 has a tab 92 that corresponds to a slot in the base.

I claim:

1. A device for a vessel and a metal shaker platform, comprising:

a base having an upper side and a lower side;

a plurality of flanges on the upper side of the base, each flange having an arm that extends away from the base and engages with the vessel so that the arms retain the vessel to the base; and a magnet on the lower side of the base that magnetically attaches the base to the platform, thereby releasably retaining the vessel to the platform; wherein the base further includes a center and a plurality of slots in the upper side; and each flange further includes a bottom portion that engages with a corresponding slot in the base, thereby configuring a distance of the flange from the center of the base.

2. The device of claim 1, wherein:

the vessel is a laboratory flask with a body and a neck; and the arm of each of the flanges is angled in toward a center of the base at an angle that causes the arm to engage with the body of the flask, thereby securely retaining the flask down onto the base while allowing the base and flask to be removed as a unit from the metal shaker platform.

3. The device of claim 1, wherein each flange may be repositioned at a common distance from a center of the base, thereby accommodating differing sizes of vessel.

4. The device of claim 1, wherein:

the base further includes the center and the plurality of slots in the upper side oriented toward the center;

each slot includes a post within the slot; and a bottom portion of each flange has a set of apertures that correspond to the posts, so that one of the apertures may be selected and aligned with the post of one of the slots, thereby positioning the flange within the slot at a selected distance from the center of the base.

5. The device of claim 1, wherein:

the base further includes the center and the plurality of slots in the upper side oriented toward the center;

each slot includes a plurality of tab retaining areas within the slot; and a bottom portion of each flange has a knob that is retained by one of the tab retaining areas of one of the slots in the base, so that the flange is retained within the slot at a selected distance from the center of the base.

6. The device of claim 1, further comprising:

a flange retainer having a flexible rim that connects to each of the plurality of flanges.

7. The device of claim 1, wherein the magnet is round; and the device further comprises a round magnet compartment that retains the magnet underneath the base so that the magnet is exposed to the metal shaker platform.

8. The device of claim 1, further comprising a retaining latch on the flange that releasably grasps the base to hold the flange to the base.

9. A device for a flask and a metal shaker platform, comprising:

a base having an upper side and a lower side;

a plurality of flanges on the upper side of the base, each flange having an arm that extends away from the base and engages with the flask so that the arms securely retain the flask down to the base, each flange including a bottom portion that engages with a corresponding slot on the upper side of the base, each flange being repositionable at a common distance from a center of the base so that the device accommodates the size of the flask; and a magnet on the lower side of the base that magnetically attaches the base to the platform, thereby releasably retaining differing sizes of flasks to a metal shaker platform.

10. The device of claim 9, further comprising:

a post within each slot on the base; and a plurality of apertures in each flange that correspond to the posts so that each flange may be securely positioned at a selected distance from a center of the base.

11. The device of claim 9, further comprising:

a flange retainer having a flexible rim that connects to each of the plurality of flanges;

a tab on a bottom of each flange that corresponds to one of the slots in the base; and a plurality of tab retaining areas in each slot that allow the tab of one of the flanges to be retained in the tab retaining area, thereby positioning each flange at a selected distance from a center of the base.

12. A method for a vessel and a metal shaker platform, comprising:

providing a holder assembly having a base with an upper side and a lower side;

positioning a plurality of flanges on the upper side of the base, each flange having an arm that extends away from the base and engages with the vessel so that the arms retain the vessel to the base; and attaching a magnet to the lower side of the base that magnetically attaches the base to the platform, thereby releasably retaining the vessel to the platform; wherein the base further includes a center and a plurality of slots in the upper side; and each flange further includes a bottom portion that engages with a corresponding slot in the base, thereby configuring a distance of the flange from the center of the base.

13. The method of claim 12, further comprising:

utilizing the magnet to magnetically retain the holder assembly to the platform;

shaking the holder assembly so as to mix a contents of the vessel; and lifting the holder assembly to release the magnetic attachment to the platform.

14. The method of claim 12, further comprising:

utilizing the holder assembly and platform to shake said vessel;

repositioning each flange on the base to a common distance from a center of the base to accommodate a second vessel having a different size than said vessel; and utilizing the holder assembly and platform to shake the second vessel.

15. The method of claim 12, further comprising:

connecting each of the flanges together with a flange retainer assembly; and rotating the flange retainer assembly so that the flanges move along the plurality of slots in the base, thereby repositioning the flanges.

* * * * *